United States Patent [19]

Cooper

[11] 3,945,503

[45] Mar. 23, 1976

[54] CRANE WITH A VARIABLE CENTER ROPE SUSPENSION SYSTEM

[75] Inventor: George W. Cooper, San Leandro, Calif.

[73] Assignee: Fruehauf Corporation

[22] Filed: Feb. 13, 1974

[21] Appl. No.: 442,092

Related U.S. Application Data

[63] Continuation-in-part of Ser. No. 77,584, Oct. 2, 1970, abandoned.

[52] U.S. Cl. ..... 212/11; 212/27; 294/67 D

[51] Int. Cl.[2] ..... B66C 17/06

[58] Field of Search ..... 212/11–15, 212/124–125, 40–41, 83, 97; 294/67 D, 67 DC

[56] References Cited

UNITED STATES PATENTS

| | | | |
|---|---|---|---|
| 2,190,093 | 2/1940 | Bossart | 187/1 X |
| 2,799,403 | 7/1957 | Friedman | 212/15 X |
| 3,081,883 | 3/1963 | Minty | 212/13 |
| 3,111,228 | 11/1963 | Anderson | 212/11 X |
| 3,254,775 | 6/1966 | Brevard et al. | 212/15 X |

FOREIGN PATENTS OR APPLICATIONS

| | | | |
|---|---|---|---|
| 897,303 | 3/1970 | Japan | 212/15 |
| 219,138 | 8/1968 | U.S.S.R. | 212/125 |
| 1,531,628 | 5/1968 | France | 212/11 |
| 233,769 | 5/1964 | Austria | 212/14 |
| 642,908 | 1/1960 | Italy | 212/15 |

*Primary Examiner*—Robert J. Spar
*Assistant Examiner*—R. B. Johnson
*Attorney, Agent, or Firm*—Bruce & McCoy

[57] ABSTRACT

A variable centers rope suspension system for a gantry crane including a pair of trolleys mounted on the crane and interconnected by a frame which reciprocates the trolleys with respect to each other. The trolleys are moved synchronously along the gantry through the drive cables being connected to the frame.

3 Claims, 8 Drawing Figures

INVENTOR.
GEORGE W. COOPER

BY Bruce & McCoy

INVENTOR.
GEORGE W. COOPER
BY Bruce & McCoy

INVENTOR.
GEORGE W. COOPER

BY Bruce & McCoy

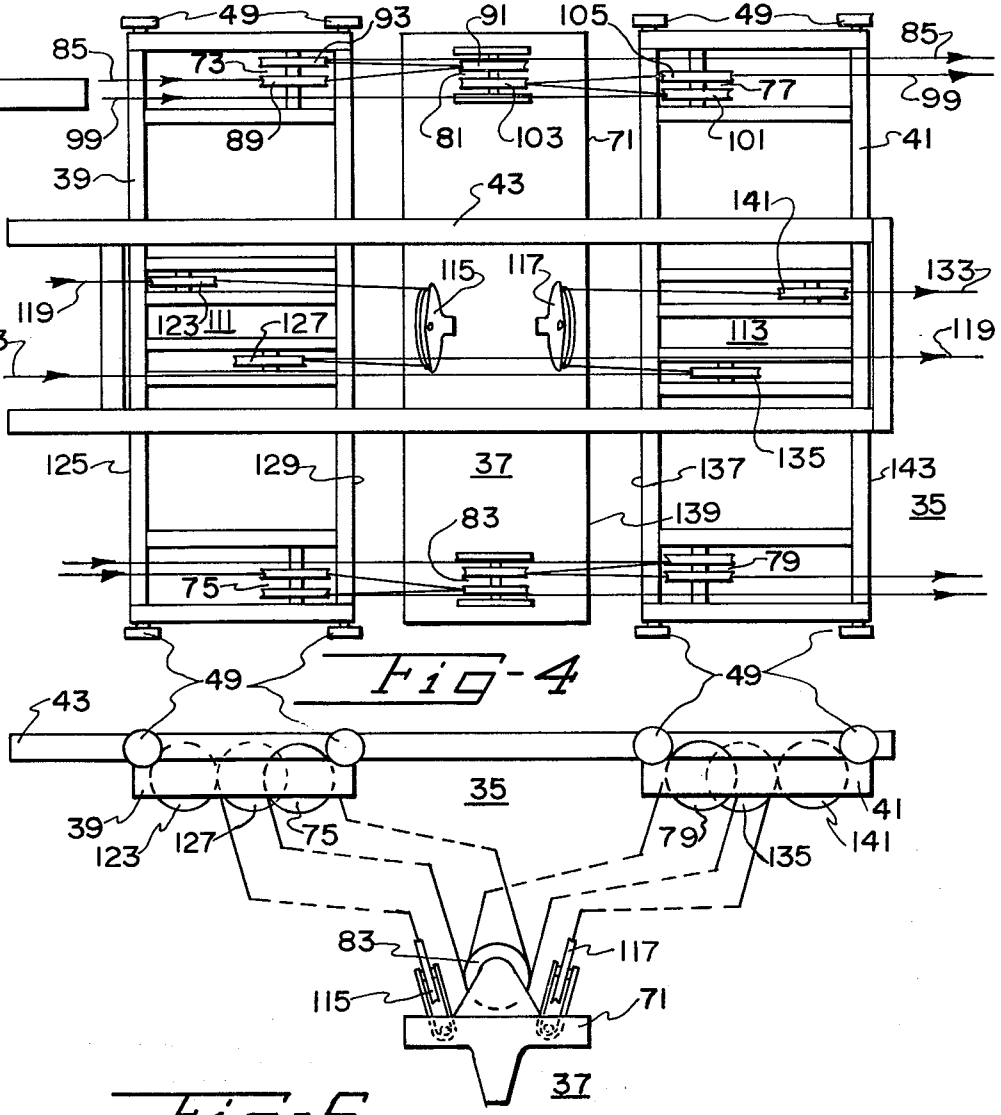
FIG-4
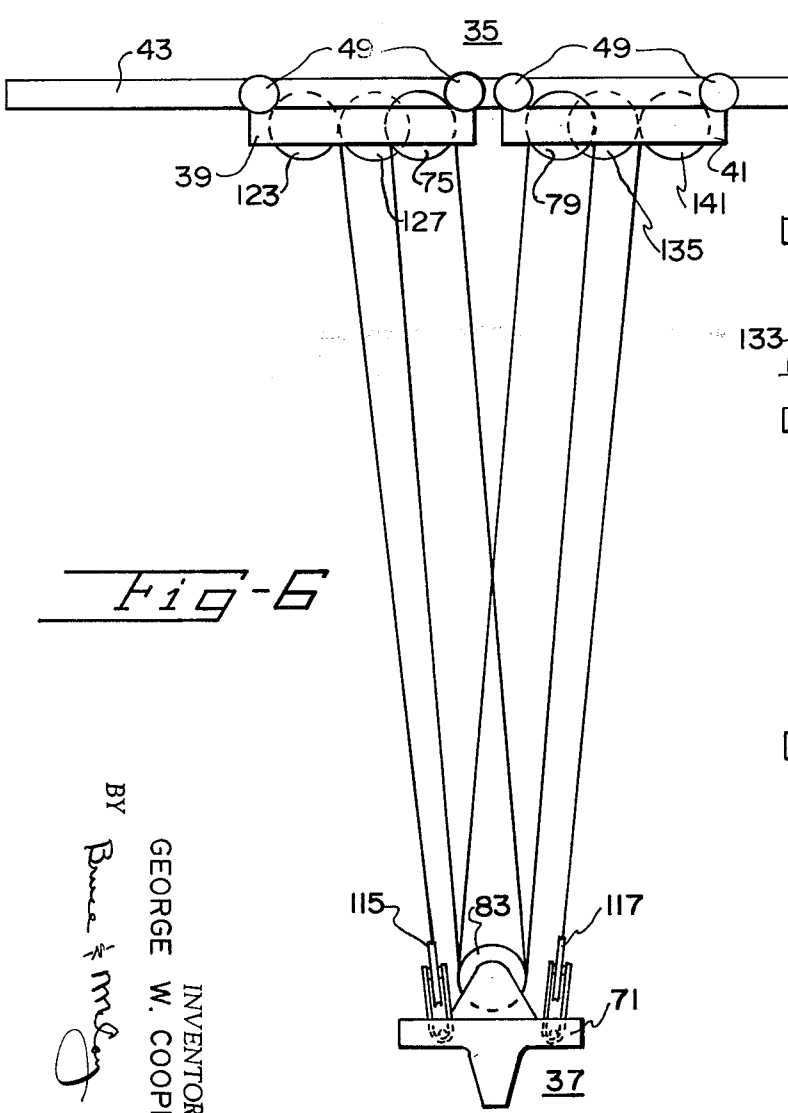
FIG-5
FIG-6
INVENTOR.
GEORGE W. COOPER
BY Bruce & McCoy INVENTOR.
GEORGE W. COOPER
BY Bruce & McCoy

INVENTOR.
GEORGE W. COOPER

BY Bruce & McCoy

CRANE WITH A VARIABLE CENTER ROPE SUSPENSION SYSTEM

CROSS-REFERENCE TO RELATED APPLICATIONS

This is a continuation of application Ser. No. 77,584 filed on Oct. 2, 1970 now abandoned.

BACKGROUND OF THE INVENTION

1. Field of the Invention

The present invention relates to anti-sway devices for inhibiting and arresting sway of a suspended load and more particularly it relates to a variable centers rope suspension system for a gantry crane. The invention is particularly adapted to large dockside cranes used to load and unload standardized cargo containers.

A problem associated with the handling of cargo by large cranes is sway of the load as the load is moved between its pickup point and its deposition point. Due to the length of the ropes supporting the load, and the distance and speed with which the load must be moved to obtain the maximum utilization of the crane, the load experiences pendulum motion due to the combined action of the horizontal acceleration and deceleration forces acting on the inertia of the load.

It is necessary to accurately position the suspended load for deposition, and to effect this it is very important to be able to stop the horizontal movement of the load and accurately place and release the load in the shortest possible time in order to reduce the cycle time of the crane in effecting the transfer of each cargo container.

In a crane suspending a load from a high gantry, inhibiting sway of the load is very difficult. The load is suspended from long ropes, and the amplitude of sway is likewise greatly increased. Since a large crane is a very expensive item to both acquire and operate, it therefore is very important to obtain maximum efficiency and utilization of the crane. To do this, it is necessary to pick up and move the load as fast as possible from its pickup point to its point of deposition. Increasing the movement speed over the same length of travel intensifies the sway problem since larger horizontal acceleration and deceleration rates are produced and these are the primary causative factors inducing sway in a load.

In the very large and expensive container cranes now being utilized, where the gantry is typically 75 to 80 feet above the dock area, a need exists for an anti-sway device for high lift cranes which can increase the handling capacity of the crane by decreasing the cycle time of moving a container between the load pickup and deposition points. This can be most effectively achieved by reducing the sway of the load while it is being handled by the crane to minimize the time required to accurately position the load for set down and release.

DESCRIPTION OF THE PRIOR ART

Many types of methods and devices have been considered for the arresting or inhibiting of sway or pendulum motion of suspended loads. One such device which considers the problems involved is disclosed in U.S. Pat. No. 3,375,938 for ANTI-SWAY DEVICE by G. H. Crittenden, et al., issued Apr. 2, 1968, to applicant's assignee. However the device of the referenced patent relates to a relatively short lift suspension system having relatively short suspension cables.

SUMMARY OF THE INVENTION

The present invention is a variable centers rope suspension system for an overhead traveling crane. It is designed to arrest or inhibit the swaying motion of a suspended load and to reduce the time necessary for locating and setting the load at its deposition point. Because of the high degree of control provided by the invention, it is particularly useful in loading and unloading containerized cargo.

In brief, the present invention includes a crane structure supporting a gantry having a pair of trolley rails mounted thereon. At least one trolley is mounted on the rails and a load engaging means is suspended from the trolley by reeving depending from sheaves mounted on the trolley. Means are provided for moving the sheaves apart a selected distance to angulate the reeving with respect to the loader engaging means, and means are provided for moving the trolley along the gantry rails to transport a load between its pickup and deposition areas. The dampening of sway in the load is accomplished by a "fleet-through" reeving arrangement and without the necessity of mounting the hoisting drums on movable trolleys. Moreover, the present invention coordinates the movements of the trolleys with reference to a single load point and prevents rocking movement of the load about a horizontal axis — a point of special importance in the handling of containerized cargo.

OBJECTS OF THE INVENTION

It is therefore an important object of the present invention to provide a variable centers rope suspension system for inhibiting and arresting pendulum motion of a suspended load.

It is another object of the present invention to provide an anti-sway device for a crane which permits the load to be moved with great horizontal speed and large acceleration and deceleration rates and quickly and accurately located over the deposition point.

It is a further object of the present invention to provide an anti-sway device for a crane which is adaptable to cranes having very large lift heights.

It is yet another object of the present invention to provide an anti-sway device for a crane which permits the load to be lowered into a deep shipboard cell without interference of the suspension cables with the cell guides.

It is yet a further object of the present invention to provide an anti-sway device for a crane which can be operated concurrently with the movement of the load between it pickup and deposition points.

It is still another object of the present invention to provide an anti-sway device for a crane which arrests pendulum motion in both directions of the sway and rotational sway around a horizontal, as well as, a vertical axis.

It is still a further object of the present invention to provide an anti-sway device which operates continually during raising and lowering of the load.

And it is yet another object of the present invention to provide an anti-sway device for a crane which includes a new method of arresting pendulum motion of a suspended load.

DESCRIPTION OF THE DRAWINGS

Other objects and advantages of the present invention will become apparent when the variable centers rope suspension system is considered in conjunction with the accompanying drawings of which:

FIG. 4 is a plan view of the trolley and frame and lifting spreader showing the reeving arrangement;

FIG. 5 is a side elevation showing the reeving arrangement with the trolleys spaced apart a selected distance;

FIG. 6 is an end elevation showing the reeving with the trolleys moved together;

DESCRIPTION OF THE PREFERRED EMBODIMENT

Reference is made to the drawings for a description of the preferred embodiment of the invention wherein like reference numbers represent like elements on corresponding views.

Figure 1:
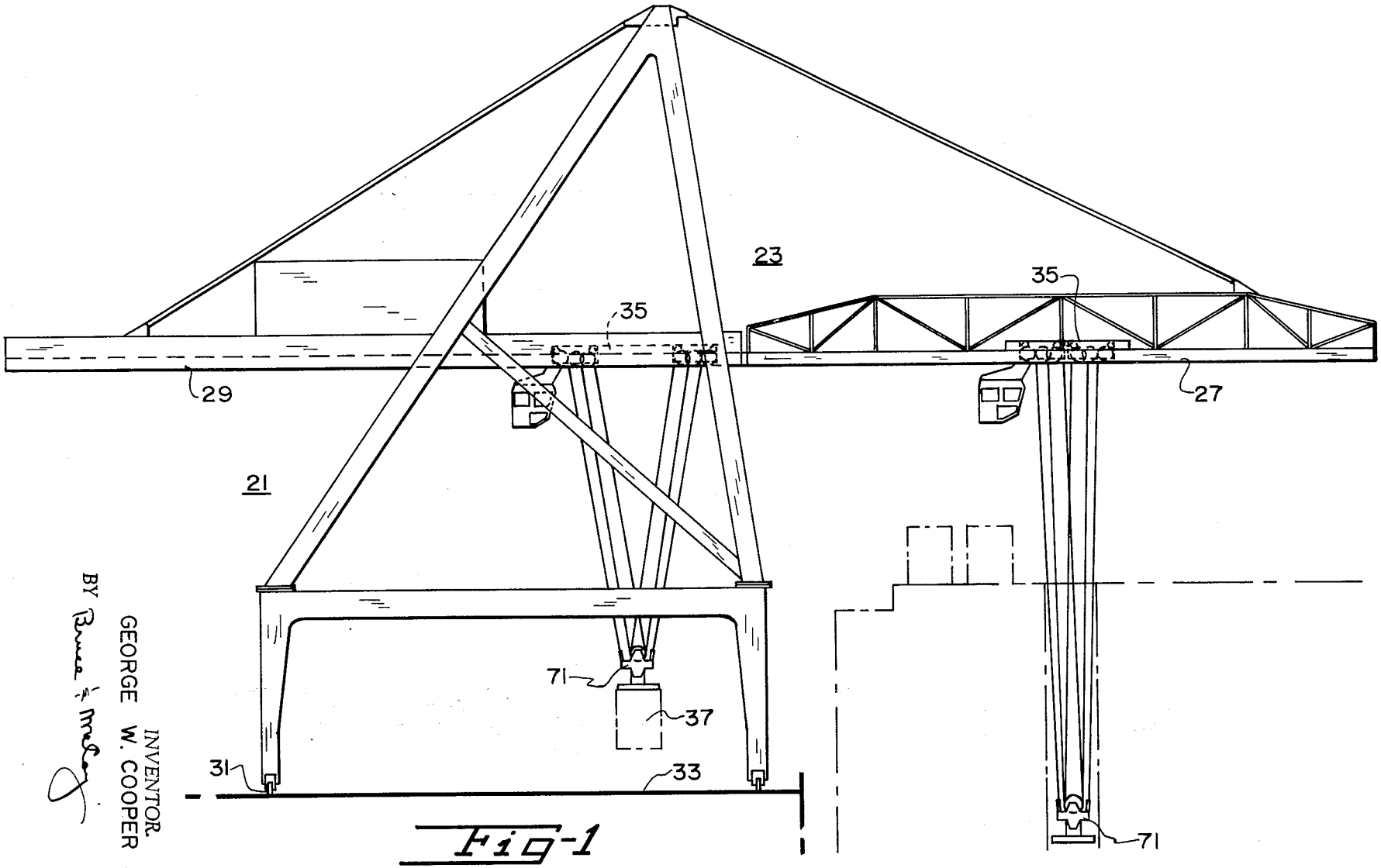
FIG. 1 is a side elevation of a typical gantry crane employing the present invention.

The present invention is a rope suspension system for an overhead traveling crane. FIG. 1 of the drawings shows a crane structure 21 supporting a gantry 23, which has trolley rails 25 thereon and which extend along both the boom portion 27 as well as the fixed portion 29 of the gantry. The crane itself is also mounted on rails 31 whereby it can be moved along the dock 33. The supporting structure of the crane is so arranged that a trolley 35 mounted on the gantry can move from one end of the gantry to the other and carry a suspended load 37 thereunder without the load physically interfering with the crane supporting structure.

A trolley 35 is mounted on the gantry rails and is movable therealong. In the preferred embodiment, the trolley actually comprises a pair of trolleys 39, 41 having means for moving said trolleys apart a selected distance. A means is provided which interconnects the trolleys and includes a frame 43 having sliding connections with each of the trolleys.

The means for moving the trolleys apart includes at least one carriage screw 45 driven by a motor 47 mounted on the frame. The carriage screw includes a right hand threaded portion engaging one of the trolleys and a left handed threaded portion engaging the other of the trolleys whereby as the carriage screw is rotated in one direction or the other the trolleys are reciprocated with respect to the frame and to each other.

Figure 2:
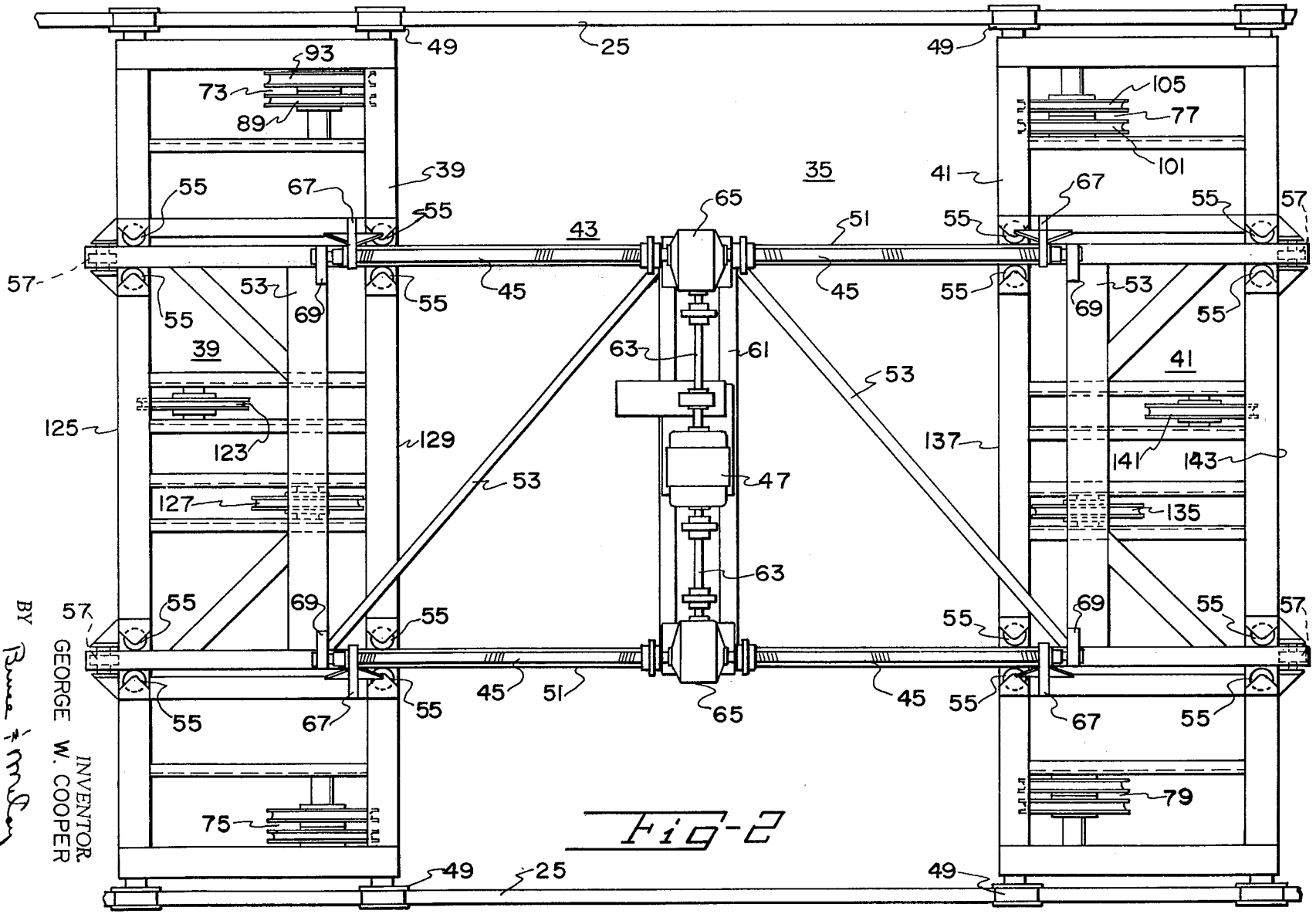
FIG. 2 is a plan view of the trolley and frame arrangement of the present invention.
Figure 3:
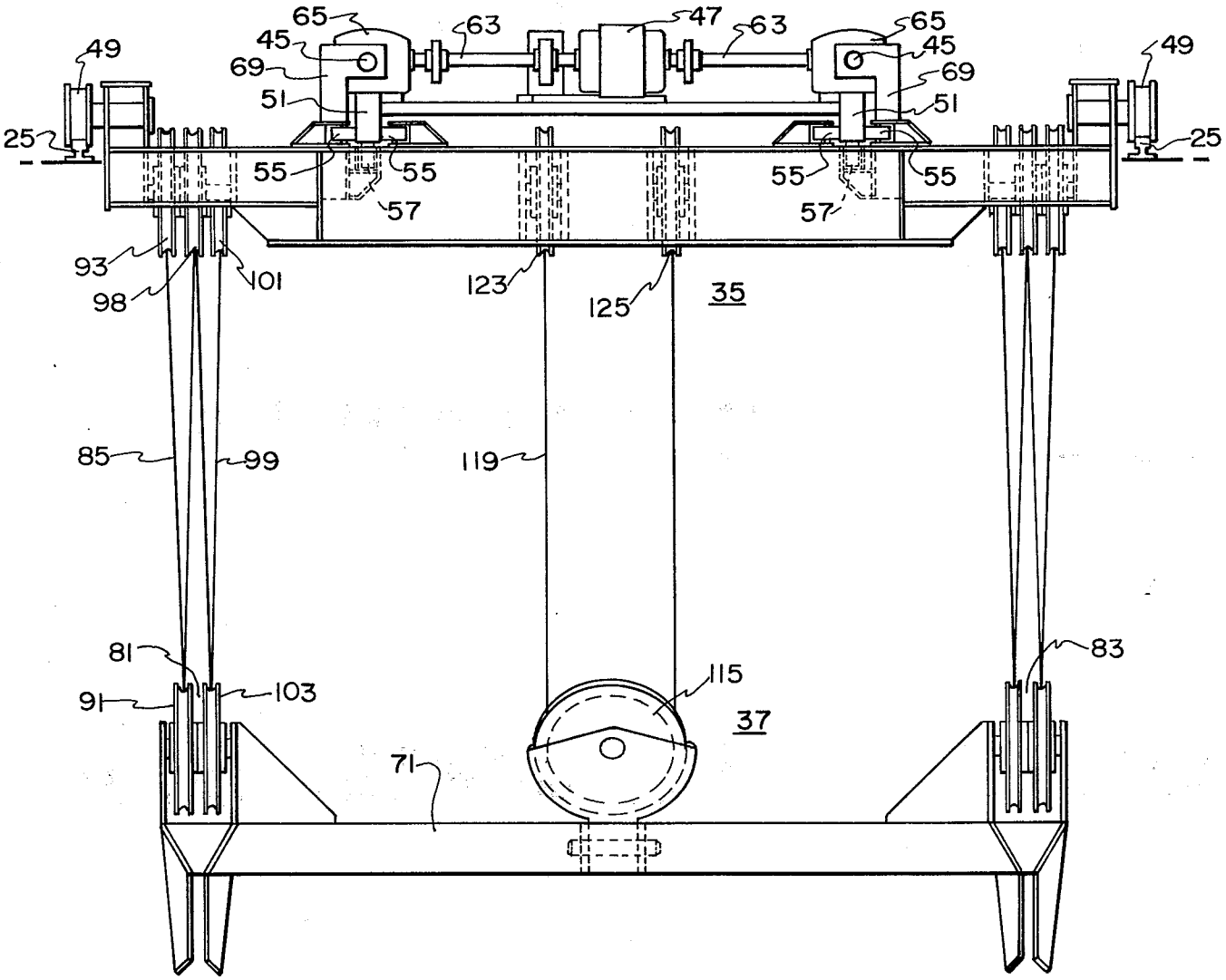
FIG. 3 is an end elevation of the trolley and frame arrangement and a suspended load as viewed along the gantry rails of the crane.
Figure 7:
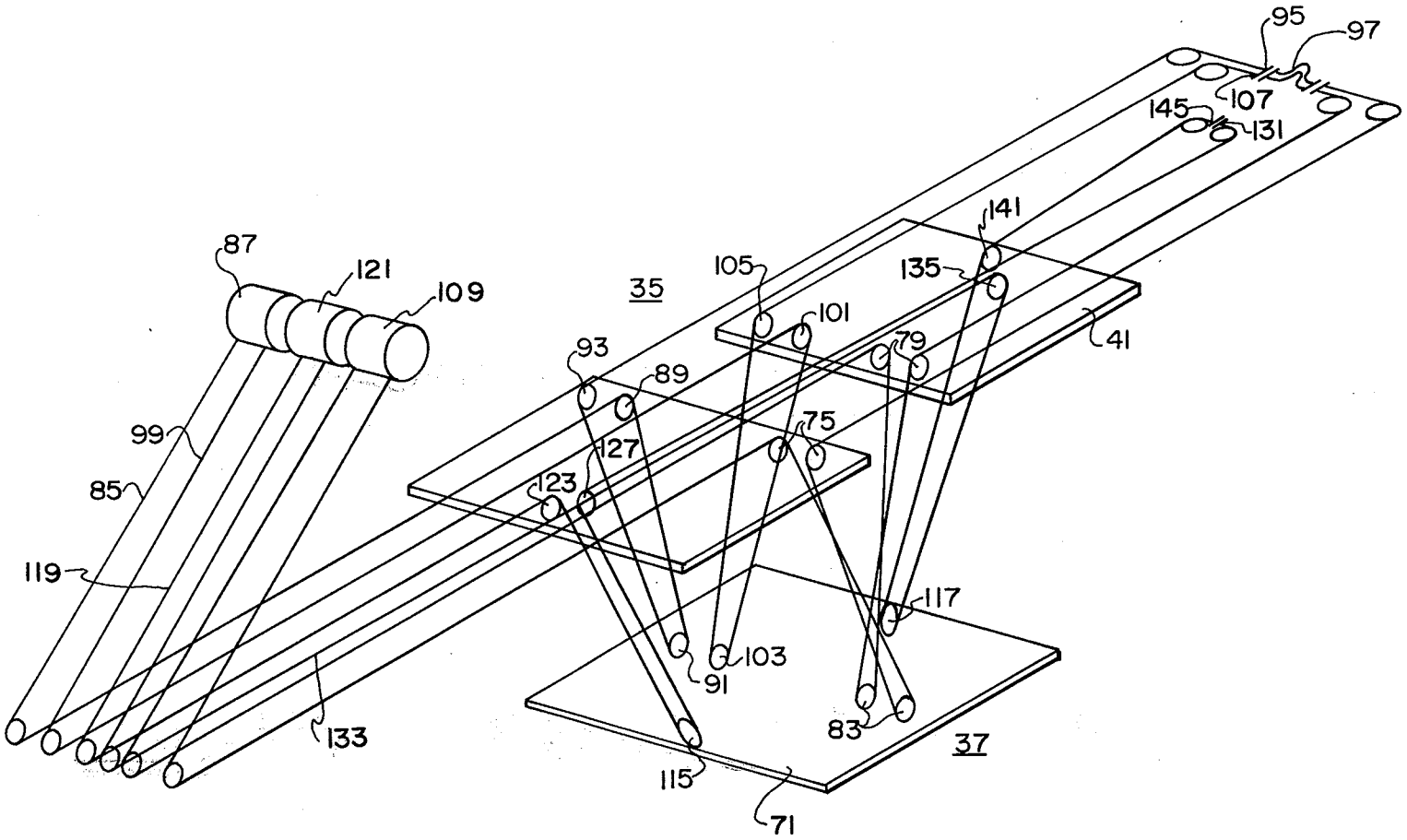
FIG. 7 is a schematic of the reeving of the trolleys and lifting spreader of the present invention.

In the preferred embodiment, the trolleys are generally rectangular and have wheels 49 mounted at the ends thereof which engage the gantry rails 25. This can be seen most clearly in FIGS. 2–4 of the drawings. The frame is shown in FIG. 2 as having longitudinal side beams 51 and interconnecting cross braces 53. The frame is carried on the trolleys by means of sliding connections which includes side 55, bottom 57, and, if necessary, top rollers (not shown) mounted on the trolleys within which the longitudinal side beams 51 of the frame reciprocate.

A motor 47 is mounted on the middle cross-brace 61 of the frame and includes a pair of drive shafts 63 which rotate differential gear transmissions 65. The gear transmissions drive carriage screws 45 which engage the trolleys through a threaded flange 67 secured to the trolleys. The outside ends of the carriage screws are mounted in bearing blocks 69 mounted on the frame. The carriage screws on opposite sides of the differential housings have opposite threads whereby as the motor is turned in one direction or the other the trolleys will reciprocate and move toward or away from each other. Limit switches are provided whereby as the trolleys reach their furthest extension or closest approach, the motor is automatically shut down to prevent any damage to the reciprocating drive system.

It is obvious that the frame 43 and drive screws 45, or any other drive means, could be fixed to one of the trolleys whereby that trolley is dominant and the other trolley acts as a movable outrigger with respect to the dominant one.

Load engaging means in the form of a lifting spreader 71 quick change headblock is suspended from the trolley 35 by reeving depending from sheaves mounted on the individual trolleys and engaging sheaves mounted on the headblock. The quick change headblock can be attached to different length lifting spreaders or to a lifting beam to permit different sizes of cargo containers to be handled as well as other types of loads. Of course, the sheaves could be mounted directly on the spreader if versatility in load handling is not required.

The reeving includes at least two sets of sheaves 73, 75, 77, 79 spaced apart on each of the trolleys and at least two sheaves 81, 83 mounted proximate each end of the headblock. In the preferred embodiment, the two sets of sheaves on the trolleys are each located in the corners of the trolleys proximate the gantry rails and proximate the adjacent edges of the two trolleys. Reference is made to FIGS. 2 and 4 which show the particular trolley and lifting spreader headlock sheave arrangements wherein the first pair of sheaves 73 of the first or left hand trolley 39 is located closer to the rails 25 than the second set of corresponding sheaves 77 on the other or second trolley at the proximate or first ends of said trolleys. A similar staggering of the sheaves is provided for the other or third and fourth sets of sheaves 75, 79 at the other corresponding or second ends of the trolleys. The sets of sheaves 81, 83 at the ends of the lifting spreader headblock are coaxially mounted at the longitudinal lift center of the headblock. It is of course obvious that other positioning of the sheaves on either the trolley or the headblock can also perform the present invention.

One wire rope is reeved from each of the sets of sheaves on each of the trolleys through at least one corresponding sheave disposed at the end of the headblock proximate or corresponding to the set of sheaves the wire rope is reeved from. In the preferred embodiment, this is effected by a first wire rope 85 being reeved from a first wire rope drum 87 outward along the gantry and over a first trolley sheave 89 in the first set of sheaves 73 on the left trolley 39 and down to the lifting spreader headblock 71, through a first load sheave of the sheaves 91 coaxially mounted in the pair of sheaves 81 at the first end of the spreader headblock proximate the first set of trolley sheaves 73 the wire rope is reeved from, back up over the other or second trolley sheave 93 of the first set of sheaves 73 on the trolley the rope is reeved from, the first trolley, and then outward until it is deadended 95 with an adjustable connection 97 at the end of the gantry. A second wire rope 99 is reeved outward along the gantry from the same or first wire rope drum 87 and over a third trolley sheave 101, one of the sheaves on the other or second trolley 41 in the set of sheaves at the first end corresponding to the first end of the first trolley, down through the other load sheave or second coaxially mounted sheave 103 of the pair of sheaves 81 at the first end of the spreader headblock, corresponding to the first ends of the first and second trolleys, and proximate the set of trolley sheaves 77 the wire rope is reeved from, and back up over a fourth trolley sheave 105 or the other sheave of the set of trolley sheaves (77) on the second trolley, and outboard to the end of the gantry where it is adjustably deadended 107.

The same wire rope reeving arrangement from a second wire rope drum 109 occurs at the other or second ends of the first and second trolleys for supporting the other or second end of the lifting spreader headblock.

To prevent or arrest rocking of the load about the coaxially mounted headblock sheaves, the reeving for suspending the lifting spreader can also include at least one middle set of sheaves 111, 113 on each of the trolleys and at least a pair of sheaves 115, 117 disposed midway from the ends of the spreader headblock with a wire rope reeved from each of the sets of the sheaves on the trolleys through at least one of the sheaves disposed midway between the ends of the headblock. In the preferred embodiment, this reeving includes a pair of staggered trolley sheaves 111, 113 mounted generally in the middle of each of the trolleys and two load sheaves 115, 117 mounted midway from the ends of the spreader headblock and turned 90° with respect to the sheaves on the trolleys. A third wire rope 119 is reeved from a third wire rope drum 121 over a fifth trolley sheave 123 located on the first trolley closer to the removed edge 125 of the first trolley, down around a third load sheave 115 on the side of the spreader headblock corresponding to the first or left trolley, back up and over a sixth trolley sheave 127 mounted on the first trolley closer to the edge 129 of the first trolley adjacent to the second trolley, and outward along the gantry and deadened at the end of the gantry with an adjustable connection 131. A fourth wire rope 133 is then reeved from the third drum 121 outboard over a seventh trolley sheave 135 mounted closer the edge 137 of the second trolley adjacent to the first trolley, down around a fourth load sheave 117 mounted on the spreader headblock on the edge 139 of the headblock corresponding or proximate to the second trolley, back up around an eighth trolley sheave 141 mounted closer the removed edge 143 of said second trolley, and outboard to the end of the gantry where it is deadended with an adjustable connection 145.

In the preferred embodiment, three wire rope drums 87, 109, 121 are utilized for driving the reeving which suspends the spreader. However, two drums could be employed with the three ropes on each side of the center of the spreader headblock being reeved over the same drum, and all wire ropes could be reeved from a single drum.

The above-described reeving arrangement is commonly known in the industry as a "fleet-through" reeving system. Its dominate characteristic is that it allows the hoisting drums and associated hardware to be mounted on the crane structure, rather than on the gantry or trolleys, while allowing free movement of the trolley without affecting the overall length of the lifting ropes and the corresponding attitude of the lifting spreader and load.

Figure 8:
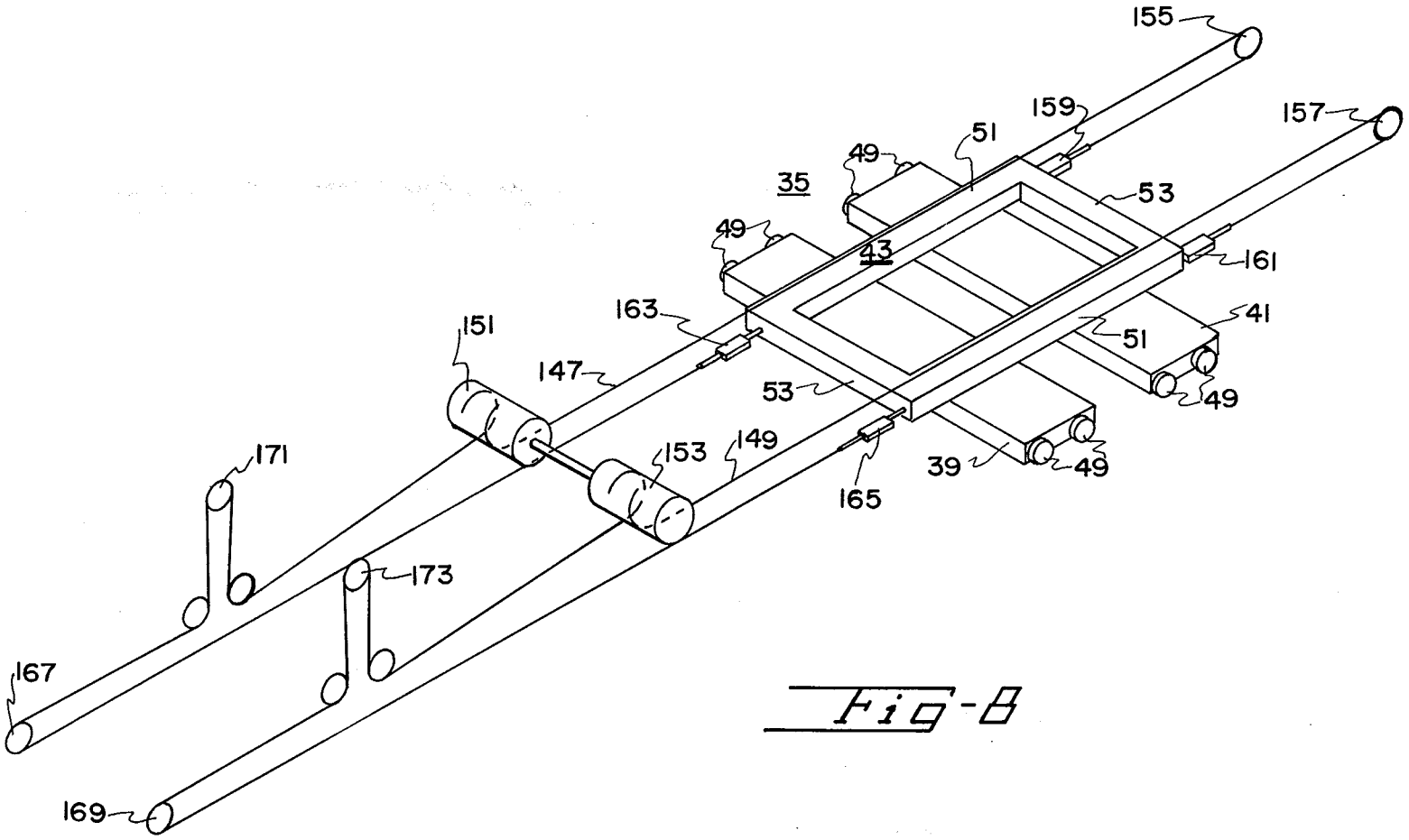
FIG. 8 is a schematic of the reeving of the drive for the trolleys on the gantry.

Means are provided for coordinated moving of the trolleys along the gantry in any selected spaced apart relation. In the preferred embodiment, this is effected by engaging the moving means with the means which interconnects the trolleys. In other words, the drive cables for the trolleys are secured to the frame 43 which interconnects them. This reeving and drive arrangement is shown in FIG. 8 of the drawings in a schematic form. Two continuously reeved wire ropes 147, 149 are wrapped around drive drums 151, 153 and run out around pulleys 155, 157 at the end of the gantry where they reverse direction and run inward and are secured 159, 161 to the trolley interconnecting frame 43. The other ends 163, 165 of the wire are secured to the frame and go rearward around reversing sheaves 167, 169 at the rear end of the gantry, up over a set of tensioner pulleys 171, 173, and outward to the drive drums 151, 153.

While the preferred embodiment of the invention shows a pair of trolleys interconnected by a frame, the trolley can be considered as a single unit having movable portions. The important feature is that means are provided for spacing the sheaves, mounted on the trolleys, apart from each other any selected distance. Thus it is contemplated that simply a single trolley could be provided with movable sheaves mounted on the trolley, and this would effect the invention equally as well as the preferred embodiment. Alternately a trolley could be provided with a movable outrigger which would carry the sheaves. In either form, the means for coordinated moving of the trolleys along the gantry would probably involve attaching the drive cables directly to the trolleys rather than to an interconnecting frame. The basic concept of the invention is the fact that sheaves supporting the lifting spreader can be moved apart on the gantry of the crane and then moved in the spaced apart relation along the gantry with synchronous movements.

In operation, the load is picked up under the crane from a stack of containers, or a railroad flat car or a truck bed or from within a cell on board a ship, or off a storage rack on the deck of a ship, and then lifted from the pickup point and moved to its deposition area. If the container is being moved from a shoreside position to on board a ship, it is picked up usually with the trolleys spread apart and moved in that condition at relatively high spaced outboard on the gantry until it is over the deposition point. If this be on top of the ship, then the trolleys can be left in their spaced apart position and the load deposited on the ship. However, if the load must be dropped into the hold of the ship within a cell, the load is moved over its deposition point, and after it has stopped swaying, the trolleys are then moved together and the load concurrently lowered into the coil guides as shown in FIG. 1 of the drawings where the trolleys are illustrated in the outboard position. This is also illustrated in FIG. 4 of the preferred embodiment views. The reeving is then retrieved and pulled up out of the ship, and as it is moved inboard, the trolleys are moved apart and spaced, and the cycle is begun again when the trolleys reach the inboard position over the pickup point.

The moving apart of the trolleys during the lifting and movement of the load angulates the reeving which supports the lifting spreader whereby sway is inhibited or arrested by placing horizontal force components on the load through the angled lifting ropes.

It will be noted in the preferred embodiment shown in the drawings that the arrangement of the trolleys and frame is such that movement of the trolleys is accomplished without any consequent shifting of the load. Movement of the trolleys in both directions occurs with reference to a central point on the frame positioned directly above the load. Accordingly, movement of the trolleys toward or away from each other does not result in any lateral displacement of the load.

An operator's cab is suspended from the end of the frame interconnecting the trolleys. It contains controls for remotely controlling the movement of the trolleys along the gantry, and for moving the trolleys apart any selected distance within the range of operation, and for operating the crane to handle the container or any other load.

It is therefore an important feature of the invention that a new and novel method of arresting sway of a load suspended from a gantry crane is provided. The method includes suspending a lifting spreader by wire ropes reeved from movable sheaves mounted on at least one trolley disposed on the gantry rails, and to inhibit sway of the load or arrest it, moving the sheaves apart when lifting a load attached to the spreader to angulate the lifting ropes with respect to the spreader. It further contemplates, instead of moving the sheaves apart, mounting the sheaves on a pair of trolleys and simply moving the trolleys apart, and then providing means for moving the trolleys synchronously in a spaced apart relation along the gantry when moving the load between the pickup and deposition areas.

It will be apparent from the foregoing description of the invention in its preferred form that it will fulfill all the objects attributable thereto, and while it is illustrated and described in detail, the invention is not to be limited to such details as have been set forth except as may be necessitated by the appended claims.

We claim:

1. A variable centers rope suspension system for suspending a load from an overhead traveling crane comprising, a crane structure, a gantry supported by said crane structure, a pair of rails mounted on said gantry, a pair of trolleys mounted and adapted to roll on said rails and supported by said gantry, a frame interconnecting said trolleys and having slidable connections therewith, means for translating said load by moving said trolleys and interconnecting frame as a unit along said gantry on said rails, means mounted on said frame for reciprocating said trolleys with respect to said frame whereby said trolleys can be synchroneously moved on said rails with respect to the centerline of the load a selected distance toward or away from each other within the limits of the frame and whereby the reciprocation of the trolleys on the rails with respect to the frame is independent of the translational movement of the load achieved by moving the trolleys and interconnecting frame as a unit, and a fleet through reeving system comprising, a load engaging means having at least two sheaves mounted thereon, at least one hoisting drum mounted on said crane structure removed from said trolleys, at least one pair of sheaves mounted on each of said trolleys, at least one pair of ropes reeved from said hoisting drum, one of said pair of ropes being reeved from said hoisting drum through one of said pair of sheaves mounted on one of said trolleys, down through one of said pair of sheaves mounted on said load engaging mean, up through the other of said pair of sheaves mounted on said trolley, and then to the outboard end of said gantry opposite said hoisting drum where it is deadended, and the other of said pair of ropes being reeved from said hoisting drum through one of said pair of sheaves mounted on the other of said trolleys, down through the other of said pair of sheaves mounted on said load engaging means, up through the other of said pair of sheaves mounted on said other trolley, and then to the outboard end of said gantry opposite said hoisting means where it is deadended.

2. The variable centers rope suspension system of claim 1 wherein said interconnecting frame includes slidable connections with said trolleys and said trolley reciprocation means includes a carriage screw driven by a motor on said frame, said carriage screw having a right-hand threaded portion engaging one of said trolleys and a left-hand threaded portion engaging the other of said trolleys for reciprocating said trolleys with respect to said frame.

3. The variable centers rope suspension system of claim 1 wherein the fleet-through reeving system further includes additional reeving comprised of an additional set of sheaves disposed midway from the ends of each of said trolleys an additional pair of sheaves disposed midway from the ends of said load engaging means, and at least one additional rope reeved from said hoist drum through said additional sets of trolley sheaves and additional load engaging means sheaves whereby said additional reeving stabilizes the load against pivoted sway about its horizontal longitudinal axis.

* * * * *